US007848663B2

(12) United States Patent
Okano

(10) Patent No.: US 7,848,663 B2
(45) Date of Patent: Dec. 7, 2010

(54) IMAGE FORMING APPARATUS CONFIGURED TO DETERMINE THE POSITION OF AN IMAGE CARRIER

(75) Inventor: Tetsuya Okano, Anjo (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 783 days.

(21) Appl. No.: 11/826,866

(22) Filed: Jul. 19, 2007

(65) Prior Publication Data

US 2008/0019721 A1 Jan. 24, 2008

(30) Foreign Application Priority Data

Jul. 24, 2006 (JP) ..... 2006-200670

(51) Int. Cl.
*G03G 15/00* (2006.01)
*G03G 15/16* (2006.01)

(52) U.S. Cl. ..... 399/13; 399/121

(58) Field of Classification Search ..... 399/13, 399/49, 53, 110, 111, 121
See application file for complete search history.

(56) References Cited

U.S. PATENT DOCUMENTS 7,171,132 B2 * 1/2007 Yabuki et al. ..... 399/13
7,454,158 B2 * 11/2008 Nakano et al. ..... 399/121

FOREIGN PATENT DOCUMENTS

JP 2001-215857 8/2001
JP 2002-328571 11/2002
JP 2005-164645 6/2005

* cited by examiner

*Primary Examiner*—William J Royer
(74) *Attorney, Agent, or Firm*—McDermott Will & Emery LLP

(57) ABSTRACT

One embodiment of the present invention can include an image forming apparatus having an image carrier, a light emitting portion capable of emitting a light towards a predetermined position, a light receiving portion capable of detecting a light amount of incident light from the predetermined position, a light emission control portion capable of changing an outgoing light amount of the light emitting portion, and a determining portion capable of determining whether or not the image carrier is disposed in the predetermined position based on a change in detected light amounts at the light receiving portion including a change in the outgoing light amount of the light emitting portion.

20 Claims, 9 Drawing Sheets

IMAGE FORMING APPARATUS CONFIGURED TO DETERMINE THE POSITION OF AN IMAGE CARRIER

CROSS REFERENCE TO RELATED APPLICATION

This application claims priority from Japanese Patent Application No. 2006-200670 filed Jul. 24, 2006. The entire content of this priority application is incorporated herein by reference.

TECHNICAL FIELD

This disclosure relates to an image forming apparatus, and more particularly to a technique that determines whether or not an image carrier is positioned at a predetermined location.

BACKGROUND

For example, in a color image forming apparatus that includes process cartridges of four colors cyan, magenta, yellow, and black, a belt conveyor apparatus (one example of an "image carrier") is positioned in order to convey a sheet to each process cartridge to perform image transfer. In this image forming apparatus, since the aforementioned belt conveyor apparatus is detachably mountable with respect to a main unit of the image forming apparatus for the purpose of improving the workability of sheet jam processing or maintenance, it is necessary to detect whether or not the belt conveyor apparatus is in the appropriate position.

A technique (hereunder, referred to as a "conventional technique") already exists in which a reflection-type photosensor is positioned as image density detecting means, and when a value of a received light amount at a light receiving portion of the photosensor deviates from a region that is used in image density detection, it is determined that there is no belt conveyor apparatus.

However, in the above described conventional technique, a configuration is adopted in which a light emitting portion of the photosensor emits light at a constant level, and the presence or absence of a belt conveyor apparatus is detected in accordance with whether or not the received light amount level of a light receiving portion at that time is outside a predetermined region. Consequently, for example, a received light amount level at the light receiving portion may decrease due to degradation of elements in the light receiving portion or light emitting portion of the aforementioned photosensor, which can result in a mistaken determination that there is no belt conveyor apparatus even though there is a belt conveyor apparatus.

For example, when degradation of elements of a light emitting portion or a light receiving portion occurs, because the difference in the level of a detected light amount of the light receiving portion will become smaller between a time when an image carrier is present and when there is no image carrier in accordance with the degradation, the determination accuracy with respect to whether or not the image carrier is disposed at a predetermined position will decline.

SUMMARY

One embodiment of the present invention can include an image forming apparatus having an image carrier, a light emitting portion capable of emitting a light towards a predetermined position, a light receiving portion capable of detecting a light amount of incident light from the predetermined position, a light emission control portion capable of changing an outgoing light amount of the light emitting portion, and a determining portion capable of determining whether or not the image carrier is disposed in the predetermined position based on a change in detected light amounts at the light receiving portion including a change in the outgoing light amount of the light emitting portion.

According to the present configuration, outgoing light amounts of a light emitting portion is changed and a determination as to whether an image carrier is disposed at a predetermined position is made based on a change in the detected light amount of the light receiving portion accompanying that change in the emitted light. Thus, even if the aforementioned degradation of elements occurs, since the amount of variation in the detected light amount of the light receiving portion does not vary greatly with respect to the unit change amount in the emitted light amount of the light emitting portion, a determination as to whether or not an image carrier is disposed at a predetermined position can be made with stable accuracy.

In this connection, the term "image forming apparatus" refers not just to a printing apparatus such as a printer (for example, a laser printer), and may be a facsimile apparatus or a multifunction device equipped with a printer function and reading function (scanner function) and the like.

The term "image carrier" refers to not only a member that directly bears a developer image such as a photosensitive drum (photosensitive member) or an intermediate transfer member (including an intermediate transfer belt), and may refer to a print medium conveying belt that indirectly bears a developer image via a print medium.

BRIEF DESCRIPTION OF THE DRAWINGS

Illustrative aspects in accordance with the invention will be described in detail with reference to the following figures wherein.

DETAILED DESCRIPTION

Illustrative aspects of the present invention will now be described referring to FIG. 1 to FIG. 9.

1. Overall Configuration of Laser Printer

Figure 1:
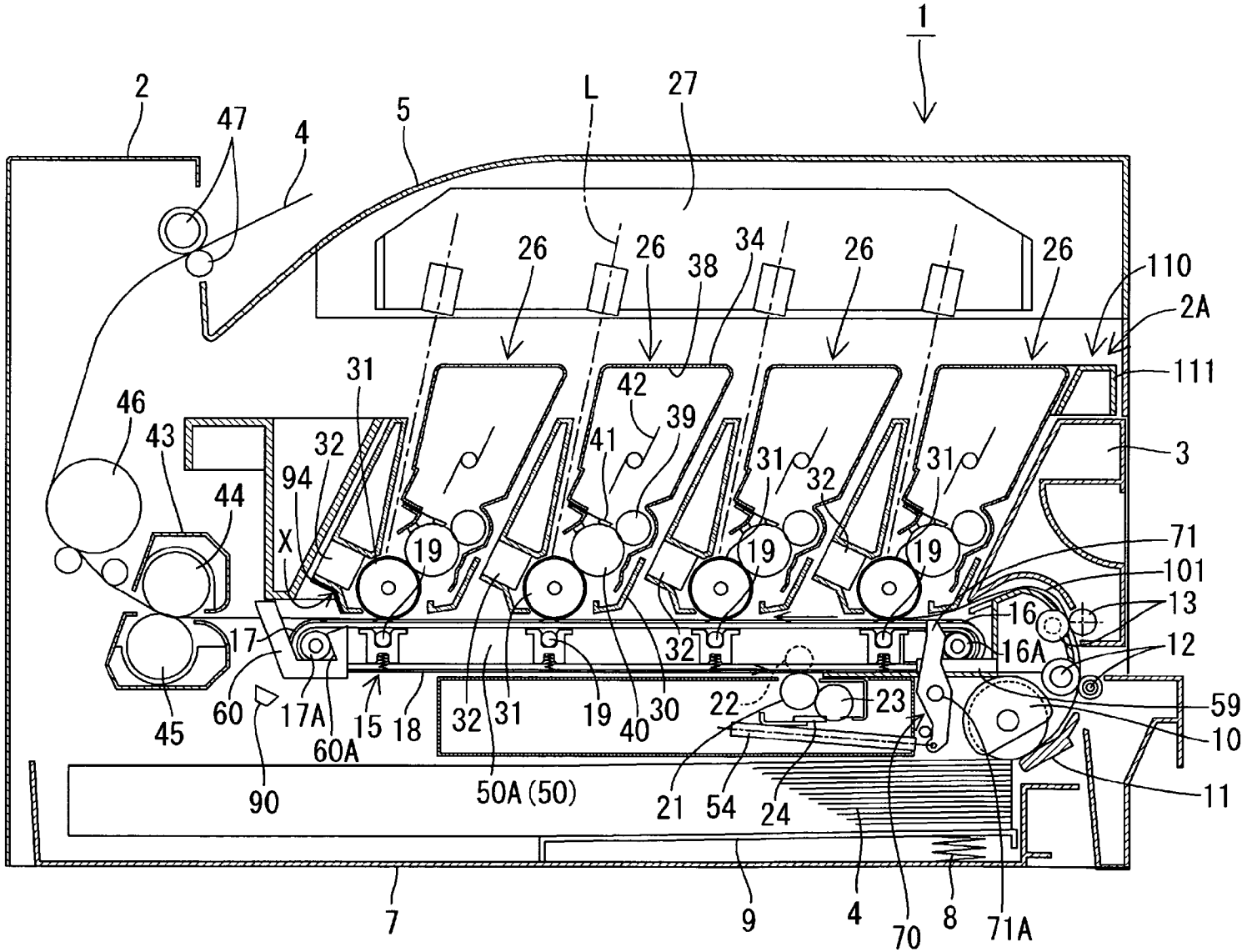
FIG. 1 is a cross section that shows a laser printer according to an illustrative aspect of the present invention.
Figure 2:
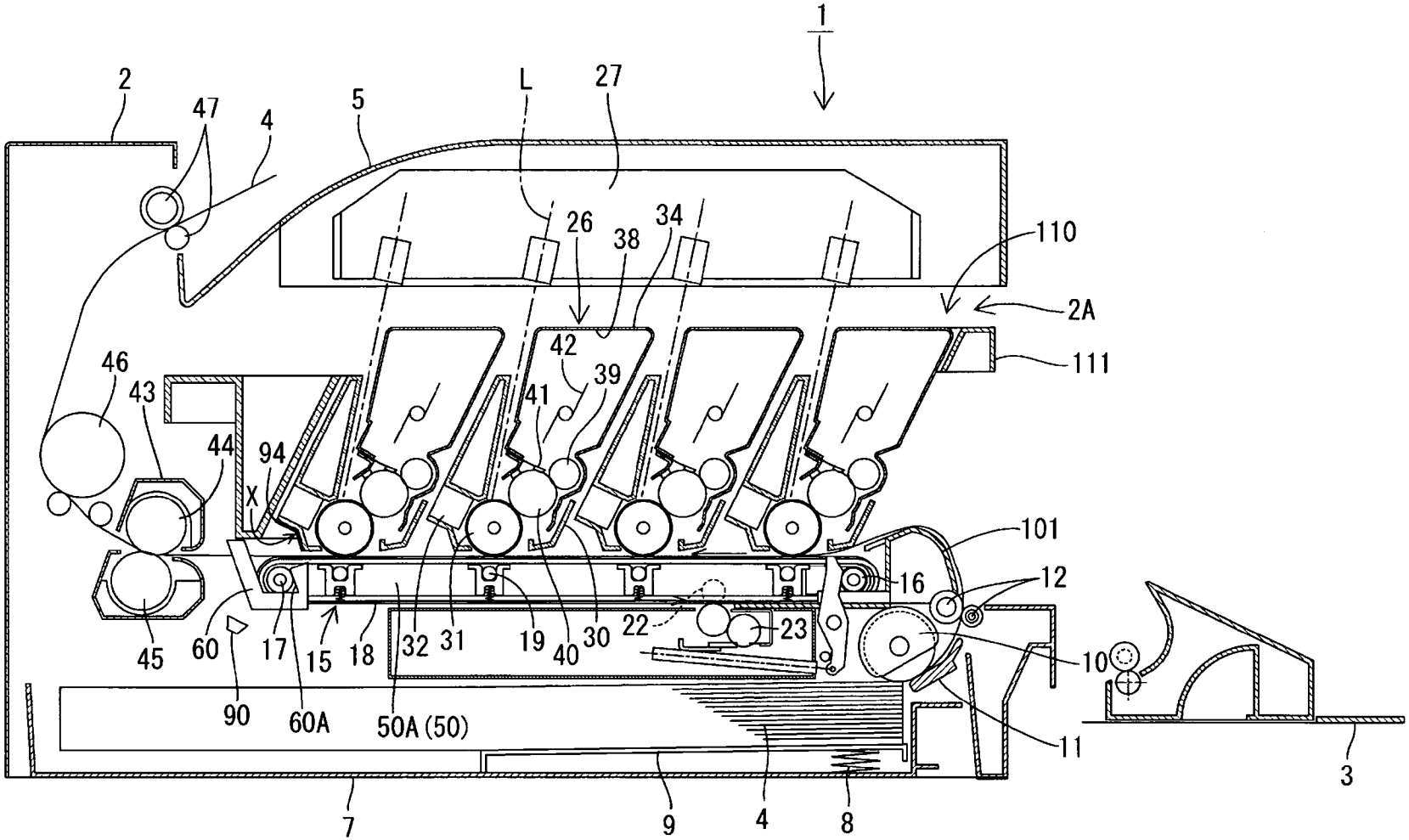
FIG. 2 is a cross section of the laser printer showing a state in which a front cover is open.

FIG. 1 is a cross section that shows a laser printer 1 (one example of an "image forming apparatus") according to the present illustrative aspect. FIG. 2 is a cross section of the laser printer 1 showing a state in which a front cover 3 is open. In the following description, the right side of FIG. 1 is taken to be the front side of the laser printer 1.

The laser printer 1 is a direct transfer tandem type color laser printer. As shown in FIG. 1, the laser printer 1 includes a casing 2 having a substantially box shape. The front cover 3 that can be opened and closed is positioned on the front of the casing 2. As shown in FIG. 2, by opening the front cover 3 it is possible to replace a process cartridge 26 or a belt unit 15 inside the casing 2. On the upper surface of the casing 2 is formed a discharge tray 5 on which sheets 4 are stacked after image formation. Herein, the term "sheet(s)" broadly refers to any recording medium including, but not limited to, paper, plastic and the like.

A sheet supply tray 7 for holding a stack of sheets 4 is mounted in a bottom portion of the casing 2. The sheet supply tray 7 can be inserted into and removed from the front of the casing 2. A sheet pressing plate 9 is positioned inside the sheet supply tray 7. The sheet pressing plate 9 is urged upwardly by a spring 8 to raise the front end side of the sheets 4. A pickup roller 10 and a separation pad 11 are provided at positions above the front end of the sheet supply tray 7. The separation pad 11 is pressed into contact with the pickup roller 10 by the urging force of a spring (not shown). A pair of sheet supply rollers 12 is positioned diagonally from the front above the pickup roller 10, and a pair of registration rollers 13 is positioned above the sheet supply rollers 12.

An uppermost sheet 4 in the stack of sheets in the sheet supply tray 7 is pressed against the pickup roller 10 by the sheet pressing plate 9, and is separated from the stack when it is pinched between the pickup roller 10 and the separation pad 11 by rotation of the pickup roller 10. The sheet 4 that is fed out from between the pickup roller 10 and the separation pad 11 is fed to the registration rollers 13 by the sheet supply rollers 12. At the registration rollers 13, the sheet 4 is fed at a predetermined timing to the belt unit 15 that is disposed behind the registration rollers 13.

The belt unit 15 is detachable from the casing 2. The belt unit 15 includes a pair of support rollers 16, 17 that are disposed at the front and rear of the belt unit 15, and a belt 18 for conveying sheets (one example of an "image carrier") that is horizontally positioned between the pair of support rollers 16, 17. Among the pair of support rollers 16 and 17, the rear-side support roller 17 is a driving roller that is rotationally driven by the power of a motor (not shown), and the front-side support roller 16 is a driven roller that fulfills a role of imparting a tensile force to the belt 18 as described later. The belt can be composed of a resin material such as polycarbonate. When the support roller 17 is rotationally driven, the belt 18 moves in a circulating manner as shown in FIG. 1 to convey the sheet 4 that has been delivered onto the upper surface of the belt 18 to the rear. Inside the belt 18, transfer rollers 19 are aligned side by side at established intervals in the front to rear direction. The transfer rollers 19 are disposed to face corresponding photosensitive drums 31 included in process cartridges 26 that are described later. The belt 18 is pinched between the transfer rollers 19 and the corresponding photosensitive drums 31. At a time of image transfer, a transfer bias is applied between each transfer roller 19 and its corresponding photosensitive drum 31.

Figure 3:
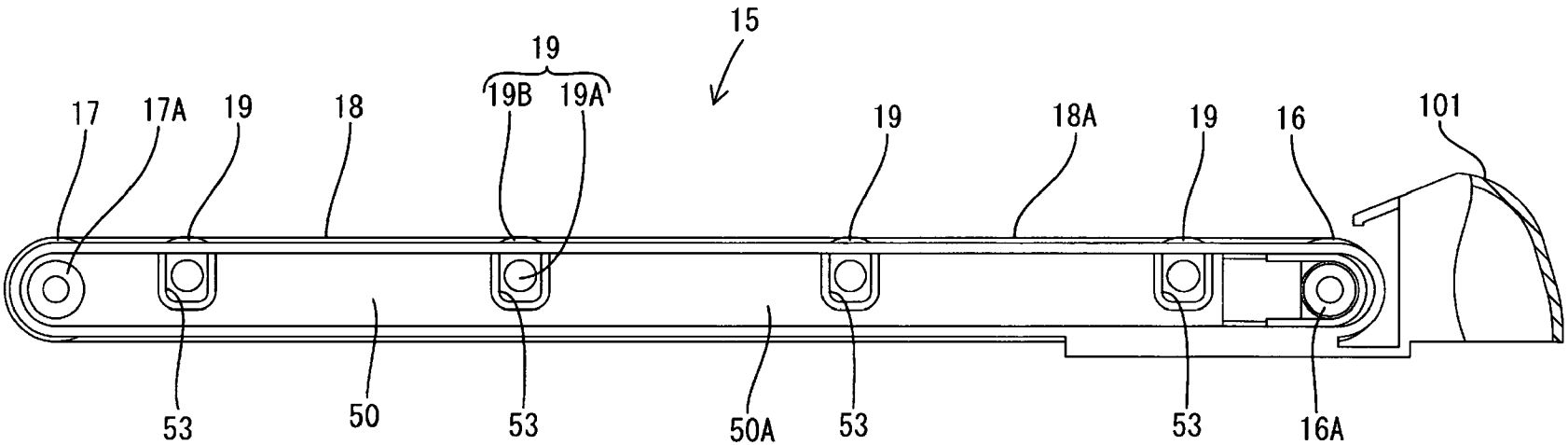
FIG. 3 is a side view showing a belt unit and a guide member.

FIG. 3 is a side view that shows the belt unit 15 and a guide member 101. As shown in FIG. 3, the belt unit 15 includes the above described belt 18 that conveys a sheet, the above described support rollers 16, 17 that support the belt 18, and a belt frame 50 that holds the support rollers 16, 17 in a rotatable condition. The belt frame 50 can be formed from an insulative synthetic resin material. Side walls 50A, 50A are positioned on the right and left sides of the belt frame 50 (the laser printer 1 is viewed from the front in each drawing, and thus only the side wall on the left side is shown in each drawing). The side walls 50A, 50A are formed such that they are coupled together at the bottom. The support roller 16 is supported at the front end of the side walls 50A, 50A and the support roller 17 is supported at the rear end of the side walls 50A, 50A. When the belt unit 15 is mounted in the casing 2, the support roller 17 is coupled with a gear mechanism (not shown) that is positioned inside the casing 2. The support roller 17 is driven by the motive force of a motor (not shown) that is positioned inside the casing 2.

In the belt frame 50, transfer roller mounting portions (not shown in the drawings) having a grooved shape that extends in the left to right direction (and opens upward) are aligned from front to rear. The transfer rollers 19 are housed in the transfer roller mounting portions. In each transfer roller 19, an electrically-conductive rubber member 19B is covered over a metal roller shaft 19A such that the roller shaft 19A protrudes laterally from the left and right sides of the rubber member 19B. As shown in FIG. 3, in the side walls 50A, 50A on the left and right of the belt frame 50, roller shaft passage holes 53 are respectively positioned at positions at the two ends on the left and right of the transfer roller mounting portions. The roller shafts 19A of the transfer rollers 19 are passed through these roller shaft passage holes 53. As shown in FIG. 3, one portion of the guide member 101 covers the upper part of a conveying surface 18A of the belt 18 and functions as a grip portion when inserting and detaching the belt unit 15, and also fulfills a function as a cover member that covers the conveying surface 18A of the belt 18.

As shown in FIG. 1 and FIG. 2, a tension imparting mechanism 70 that has coiled springs 54 is positioned on the casing 2 side at the front end side of the belt unit 15. More specifically, the tension imparting mechanism 70 comprises a pair of levers 71 on the right and left (only one of the sides is shown in FIG. 1 and the like) that are rotatably supported by a rotating shaft 71A whose center portion is disposed along the left to right direction, and a pair of coiled springs 54 (only one of the sides is shown in FIG. 1 and the like) that urge the respective levers 71. The rear end side of each of the coiled springs 54 is fixed to the casing 2 side, and the front end side that is the free end is linked to the bottom portion of each of the levers 71. The top end portion of each lever 71 can oscillate against the tensile force of the respective one of the coiled springs 54. The two sets of a lever 71 and a coiled spring 54 are disposed so as to pinch the front end side of the housed belt unit 15 with the pair of levers 71.

Further, unit support portions 59, 60 that position the belt unit 15 are positioned in a portion of the apparatus main unit that houses the belt unit 15. The unit support portion 59 supports a pair of bearing portions 16A on the left and right that respectively support the left and right ends of the roller shaft of the support roller 16 that protrudes from the belt frame 50 of the belt unit 15. The unit support portion 60 includes a guide groove 60A into which a pair of bearing portions 17A are inserted that respectively support the left and right ends of the roller shaft of the support roller 17 that protrudes from the belt frame 50 (see FIG. 1 or the like). In this state, the belt unit 15 is in a state in which it is normally mounted in the casing 2. At this time, the top end of each lever 71 contacts the bearing portion 16A of the support roller 16 from the rear so that the coiled springs 54 are elastically deformed into an expanded state. The restoring force of the coiled springs 54 urges the support roller 16 in a direction away from (frontward) the support roller 17, and thus a tensile force is imparted to the belt 18.

According to the present illustrative aspect, the belt unit 15 includes a belt tension release portion (not shown) that contacts against each lever 71 to cause the top end of each lever 71 to withdraw toward the rear during the process of mounting the belt unit 15 onto the unit support portions 59, 60 from the top, and then releases the levers 71 from the withdrawn state upon the belt unit 15 entering a state in which it is normally mounted as described above (state shown in FIG. 1). It is thereby possible to cause the levers 71 to move from a withdrawn state to a released state in response to the operation to mount the belt unit 15.

A cleaning roller 21 is disposed below the belt unit 15 to remove impurities such as toner (developer) and paper dust that adhere to the belt 18. The cleaning roller 21 can be formed by covering a metallic shaft member with a foaming material comprising silicone. The cleaning roller 21 faces a metallic backup roller 22 positioned in the belt unit 15, in a condition in which the belt 18 is positioned between the cleaning roller 21 and the backup roller 22. A predetermined bias is applied between the cleaning roller 21 and the backup roller 22, so that impurities such as toner on the belt 18 are electrically attracted to the cleaning roller 21. The cleaning roller 21 contacts against a metallic collecting roller 23 for removing impurities (such as toner) adhering to the surface of the cleaning roller 21, and the collecting roller 23 contacts against a blade 24 which scrapes off impurities such as toner adhering to the surface of the collecting roller 23.

Process cartridges 26 are detachably mounted side-by-side in the front to rear direction above the belt unit 15. The process cartridges 26 can separately (and respectively) include, for example, the colors magenta, yellow, cyan, and black. A scanner portion 27 is positioned on top of the process cartridges 26. Based on image data, the scanner portion 27 irradiates a laser beam L for each color onto the surface of the corresponding photosensitive drum 31 by high speed scanning.

Each process cartridge 26 comprises a frame-shaped cartridge frame 30, a charging device 32 (i.e. of a scorotron type), and a photosensitive drum 31 arranged at the bottom of the cartridge frame 30, and a development cartridge 34 that is detachably mounted on the cartridge frame 30. The photosensitive drum 31 comprises a grounded metal drum main unit, and is formed by coating the surface layer thereof with a positively charged photosensitive layer made of polycarbonate or the like.

The charging device 32 is disposed facing the photosensitive drum 31 in a position diagonally above the rear side of the photosensitive drum 31. The charging device 32 is spaced from the photosensitive drum 31 by a specified distance so as not to come in contact therewith. The charging device 32 generates a corona discharge from a charging wire such as a tungsten wire, so as to positively and uniformly charge the surface of the photosensitive drum 31.

The development cartridge 34 is formed in a substantially box shape. A toner containing chamber 38 is positioned at an upper portion inside the development cartridge 34. A supply roller 39, a developing roller 40 and a layer thickness regulating blade 41 are positioned at a lower portion of the development cartridge 34. Each toner containing chamber 38 can contain, as developer, a positive charging non-magnetic single-component toner of the colors yellow, magenta, cyan, and black, respectively. Each toner containing chamber 38 is provided with an agitator 42 for agitating toner.

Toner discharged from the toner containing chamber 38 is supplied to the developing roller 40 through the rotation of the supply roller 39, and is positively charged by friction between the supply roller 39 and the developing roller 40. The toner supplied onto the developing roller 40 enters the region between the layer thickness regulating blade 41 and the developing roller 40 accompanying rotation of the developing roller 40, and is further charged thoroughly by friction at this point and carried as a thin layer having a specified thickness on the developing roller 40.

The surface of the photosensitive drum 31 is first uniformly and positively charged by the charging device 32 during its rotation, and thereafter is exposed to the laser light emitted from the scanner portion 27 by high speed scanning. Thus, an electrostatic latent image corresponding to an image to be formed on a sheet 4 is formed on the surface of the photosensitive drum 31.

Subsequently, when the positively charged toner carried on the developing roller 40 faces and contacts the photosensitive drum 31 through the rotation of the developing roller 40, the toner is supplied to the electrostatic latent image formed on the surface of the photosensitive drum 31. Thereby, the electrostatic latent image on the photosensitive drum 31 is visualized, and a toner image (developer image) formed by reversal development is carried on the surface of the photosensitive drum 31.

Thereafter, the toner images carried on the surfaces of each photosensitive drum 31 are transferred in sequence onto the sheet 4 by a negative transfer bias that is applied to the transfer rollers 19 while the sheet 4 that is conveyed by the belt 18 passes through each transferring position between the transfer rollers 19 and the photosensitive drums 31. The sheet 4 onto which toner images are transferred in this manner is conveyed to a fixing device 43.

The fixing device 43 is disposed rearward of the belt 18 inside the casing 2. The fixing device 43 fixes the toner images to the sheet 4 carrying the toner images of four colors by heating the sheet 4 while the sheet 4 is being pinched and conveyed by a heat roller 44 and a pressure roller 45. Thereafter, the sheet 4 on which the toner images have been fixed by heating is conveyed to discharge rollers 47 that are positioned in an upper portion of the casing 2 by a conveying roller 46 positioned diagonally from the rear above the fixing device 43. The sheet 4 is discharged onto the aforementioned discharge tray 5 by the discharge rollers 47.

(Insertion and Removal of Belt Unit)

Figure 4:
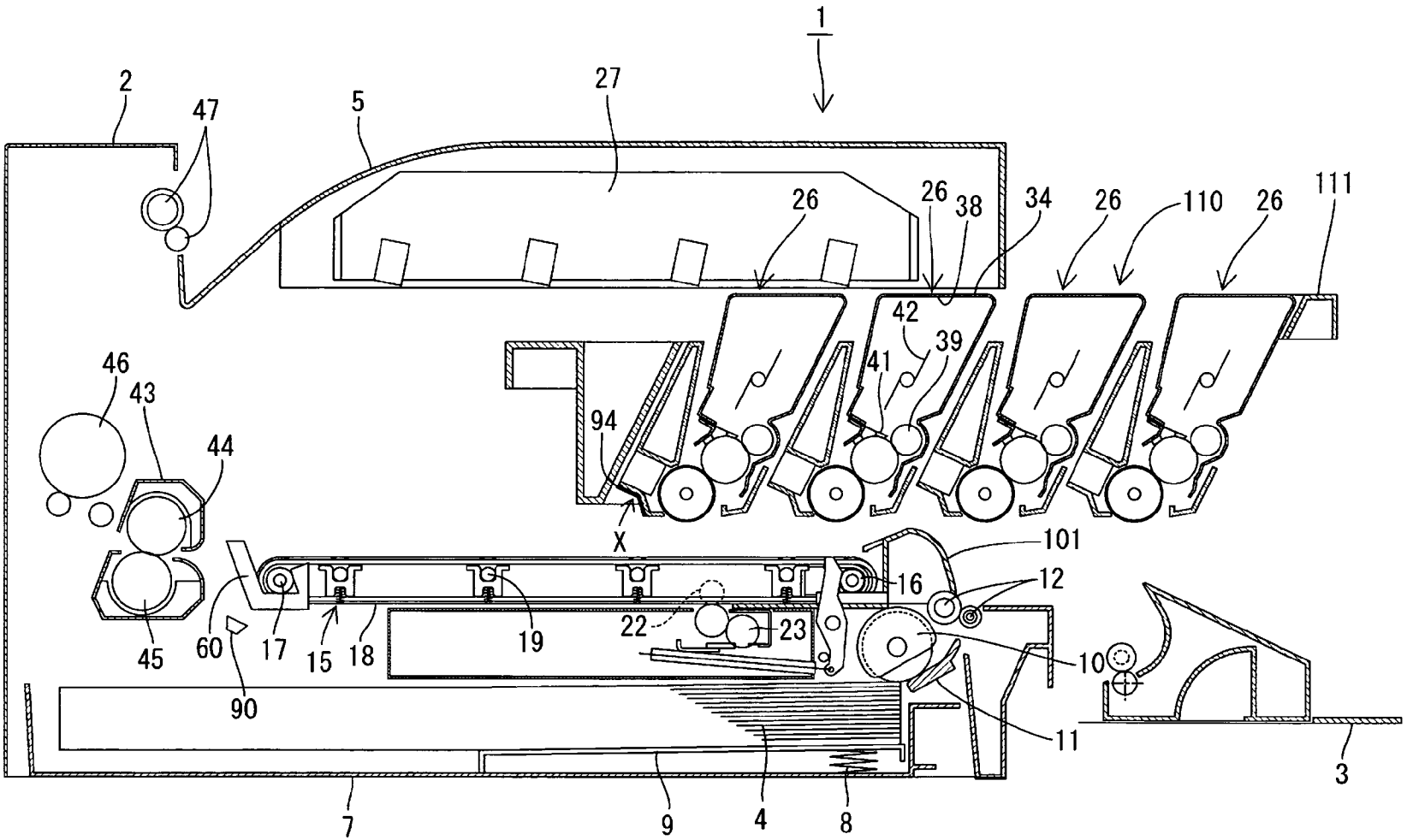
FIG. 4 is a cross section of a laser printer that shows a state in which an image forming unit is drawn out.

According to the structure of the present illustrative aspect, a frame 111 that holds the process cartridges 26 is disposed inside the casing 2 and, as shown in FIG. 4, an image forming unit 110 that includes the frame 111 and the four process cartridges 26 is removable from an opening 2A formed in the casing 2. When removing the belt 18, first the user opens the front cover 3 as shown in FIG. 2, and next takes out the entire image forming unit 110 as shown in FIG. 4 to enable access to the belt unit 15 through the opening 2A.

Figure 5:
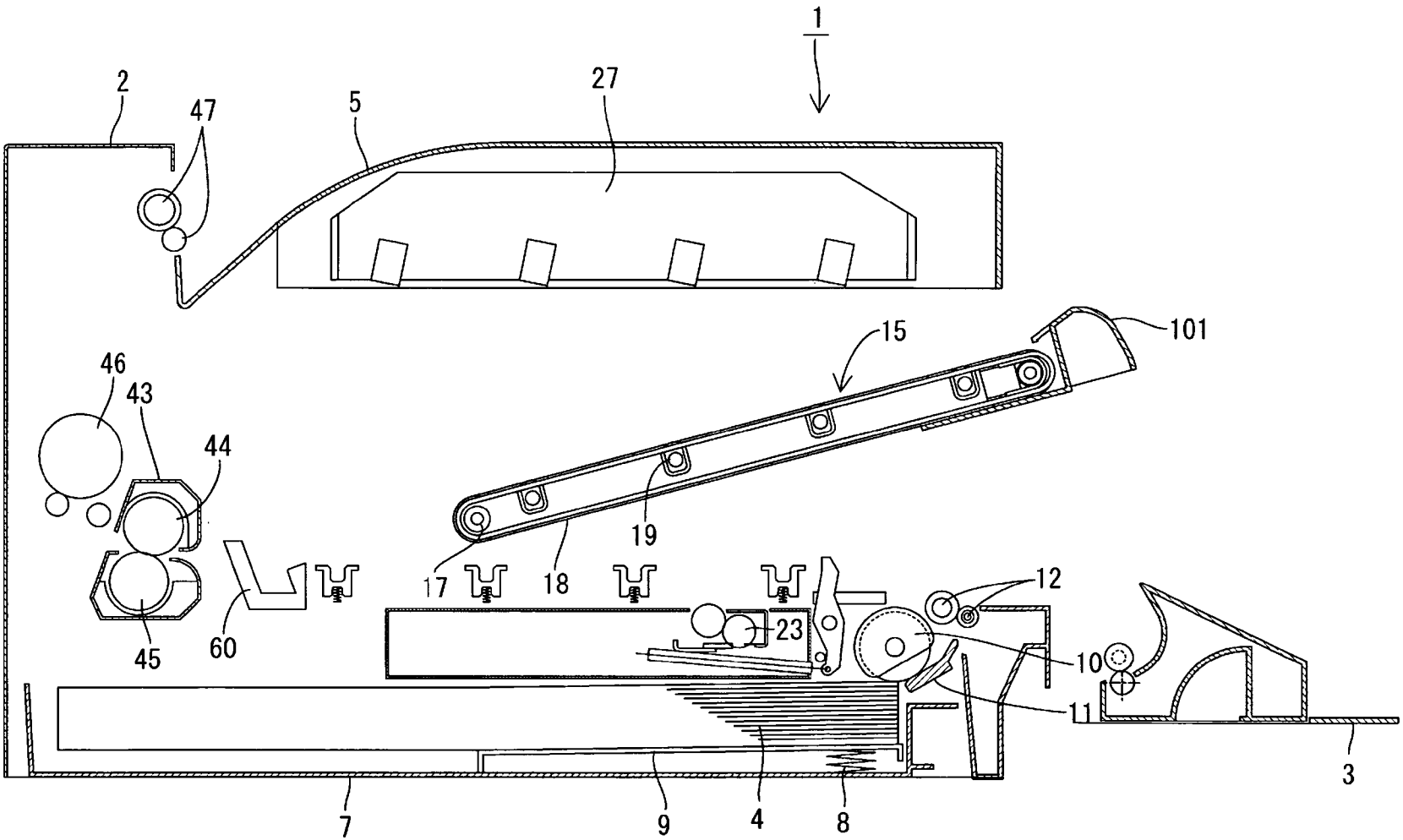
FIG. 5 is a cross section of a laser printer showing a state in which a belt unit is removed.

As shown in FIG. 5, dismounting the image forming unit 110 from the casing 2 makes it possible to insert the belt unit 15 into the casing 2 or remove the belt unit 15 therefrom through the opening 2A. In this connection, since the guide member 101 that is formed in an integral manner with the belt unit 15 is disposed at a position that is closer to the opening 2A than the belt 18, when the image forming unit 110 is taken out, access can be easily made to the guide member 101 through the opening 2A. Accordingly, it is possible to grip the guide member 101 and easily remove the belt unit 15 from the casing 2.

(Image Density Control)

Figure 6:
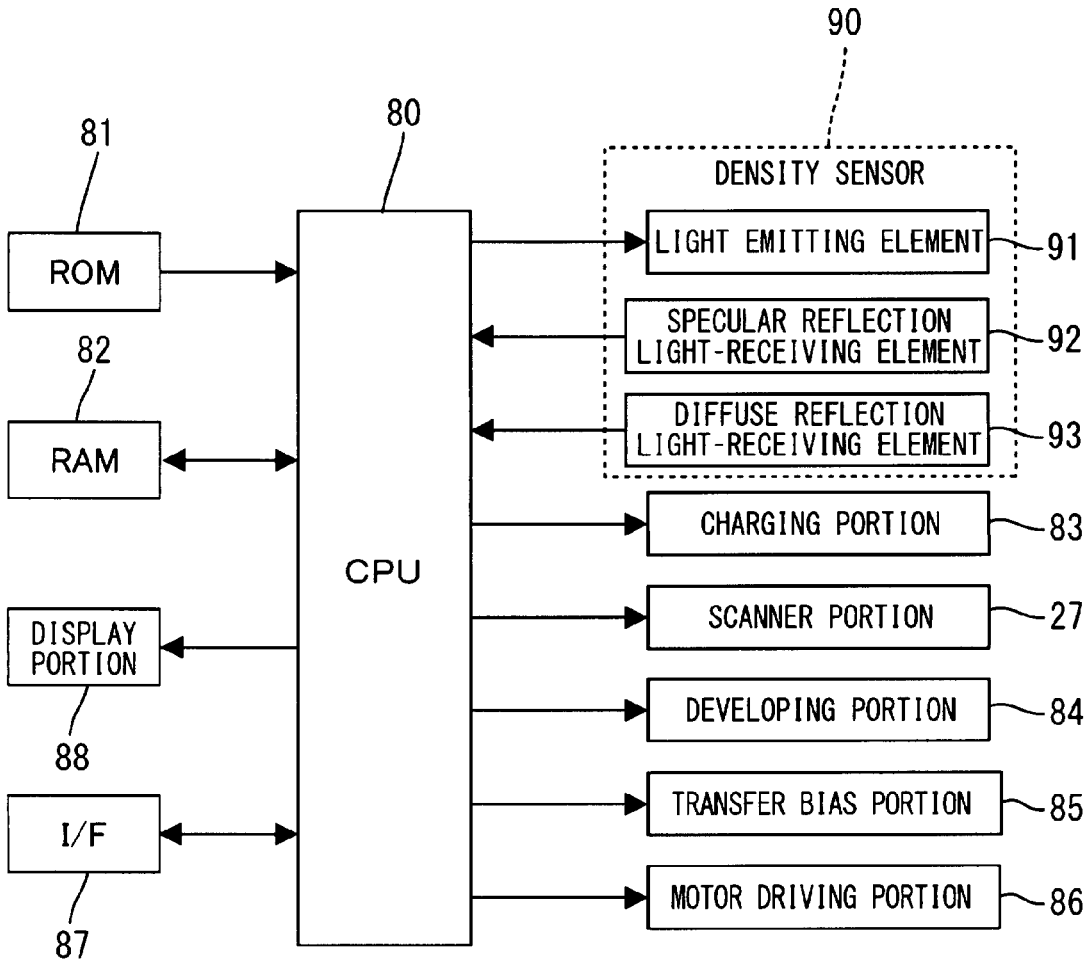
FIG. 6 is a block diagram of a control system.

FIG. 6 is a block diagram of the control system of the laser printer 1. As shown in FIG. 6, a CPU 80 (control portion) that is responsible for overall control of the laser printer 1 is positioned in the laser printer 1. A ROM 81 that stores an operating program for the entire apparatus and the like and a RAM 82 for storing image data to be used in print processing and the like are connected to the CPU 80. The CPU 80 also controls a charging portion 83 that drives the aforementioned charging device 32, the scanner portion 27, a developing portion 84 that drives the development cartridge 34, and a transfer bias portion 85 for transferring toner images on the photosensitive drums 31 onto a sheet 4. A motor driving portion 86 that drives a drum motor that is the driving source of the photosensitive drums 31 and a driving motor of the support roller 17 that cause the belt 18 to move are also controlled by the CPU 80.

The CPU 80 can also be connected to a communication terminal (not shown) such as a personal computer through an interface 87. The laser printer 1 controls driving of the scanner portion 27 based on image data that is input from the communication terminal. A display portion 88 comprising an LCD (liquid crystal display) is connected to the CPU 80. Information regarding whether or not to execute image formation and the presence or absence of the belt 18 (belt unit 15) and the like is displayed on the display portion 88. A density sensor 90 (one example of a "density sensor") comprising a light emitting element 91 (one example of a "light emitting portion"; for example, an LED) and reflection-type photosensors having light-receiving elements 92, 93 (for example, a photodiode or a phototransistor) for detecting image density is also connected to the CPU 80. The density sensor 90 is a device in which the light emitting element 91 radiates light onto a toner patch image that has been transferred onto the belt 18, and the light-receiving elements 92, 93 detect the received amount of light that is reflected from the toner patch image.

The density sensor 90 is disposed such that detection of image density is possible when the belt 18 is at an appropriate position below the photosensitive drums 31. More specifically, as shown in FIG. 1 and the like, the density sensor 90 is disposed diagonally in the lower rear portion of the belt unit 15. The light emitting element 91 is positioned such that the optical axis thereof is directed toward the belt 18 and a bottom surface X (one example of "position at which outgoing light from the light emitting portion is radiated when an image carrier is not disposed") of a rear end portion of the process cartridge 26 positioned at the most rearward end. The specular reflection light-receiving element 92 (one example of a "first light-receiving element") is disposed at a position that receives specular reflection light that is reflected by the belt 18 when light is emitted from the light emitting element 91. The diffuse reflection light-receiving element 93 (one example of a "second light-receiving element") is disposed at a position that receives diffuse reflection light that is reflected by the belt 18 when light is emitted from the light emitting element 91. Further, a black seal member 94 (one example of a "light absorbing member") is attached at the bottom surface X of the rear end portion of the aforementioned process cartridge 26 at which outgoing light from the light emitting element 91 is radiated in a state where the belt unit 15 is not present.

Based on an image density detection value from the density sensor 90, the CPU 80 performs control to adjust driving of the aforementioned charging portion 83, scanner portion 27, developing portion 84 and transfer bias portion 85 to enable image formation at an appropriate image density (one example of "developer image formation control"). First, the CPU 80 performs control to transfer a toner patch image of each color onto the belt 18 without conveying a sheet 4, radiate light at the toner patch images from the light emitting element 91 of the density sensor 90, and detect the received light amounts of that reflected light with the light-receiving elements 92 and 93. The CPU 80 receives a signal representing the received light amounts that are detected by the light-receiving elements 92 and 93 as image density detection values. The amount of specular reflection light is liable to change in accordance with the density of a black toner patch image, more specifically, a black toner patch image has a characteristic that the specular reflection light decreases in accordance with an increase in the density. Therefore, when a large amount of light is received by the specular reflection light-receiving element 92 the CPU 80 determines that the image density for black is thin, and when a small amount of light is received the CPU 80 determines that the image density for black is thick. The amount of diffuse reflection light is liable to change in accordance with the density of a yellow, magenta, or cyan toner patch image. More specifically, these toner patch images have a characteristic that the diffuse reflection light increases in accordance with an increase in the density. Therefore, when a large amount of light is received by the diffuse reflection light-receiving element 93 the CPU 80 determines that the image density for yellow, magenta, and cyan is thick. When a small amount of light is received the CPU 80 determines that the image density for yellow, magenta, and cyan is thin.

Thus, the CPU 80 detects the image density of a toner patch image of each color using the density sensor 90, and when the density is lower than the appropriate toner density, the CPU 80 adjusts the image formation conditions at the photosensitive drum 31 of the color in question. For example, an image of an appropriate toner density can be obtained by supplying new toner into the development cartridge 34, or controlling the developing bias voltage or the transfer bias voltage or the like. Since a color image is formed by overlaying toner images of different colors, an image with vivid colors cannot be obtained if the density of a toner image of any of the colors is outside an appropriate range. Therefore, the above described adjustment is performed. After performing this image density control, the toner patch images on the belt 18 are removed by the aforementioned cleaning roller 21. At that time, the CPU 80 functions as a "developer image formation control portion".

To improve the detection accuracy when performing image density detection, it is desirable to adjust the outgoing light amount of the light emitting element 91 for each color of the toner images that have different reflectance ratios to each other. Therefore, according to the present illustrative aspect a configuration is adopted in which the outgoing light amount of the light emitting element 91 can be adjusted by PWM control by the CPU 80.

(Determining the Presence/Absence of Belt Unit)

Figure 7:
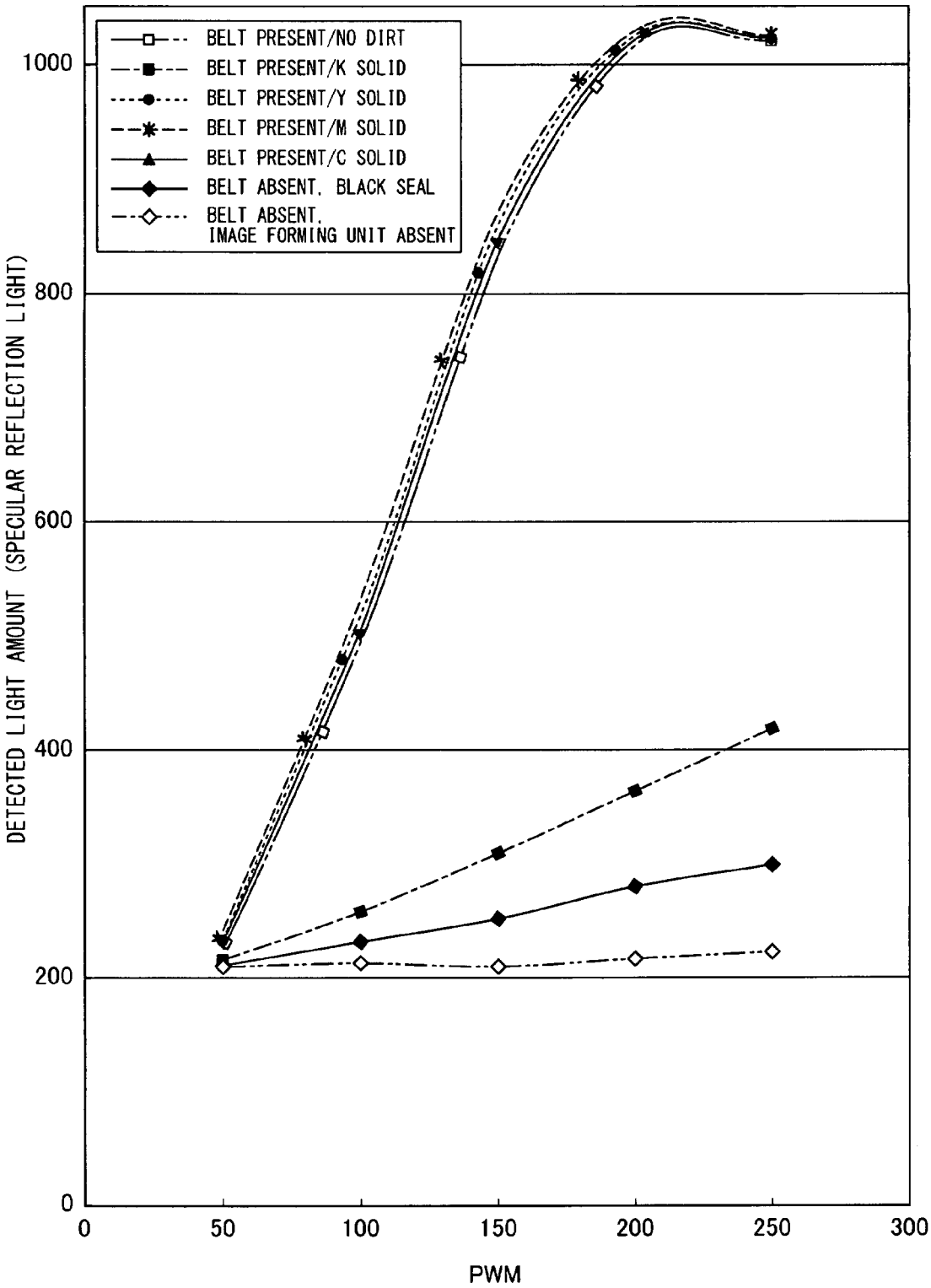
FIG. 7 is a graph that shows changes in detected light amounts of a specular reflection light-receiving element accompanying changes in outgoing light amounts of a light emitting element.
Figure 8:
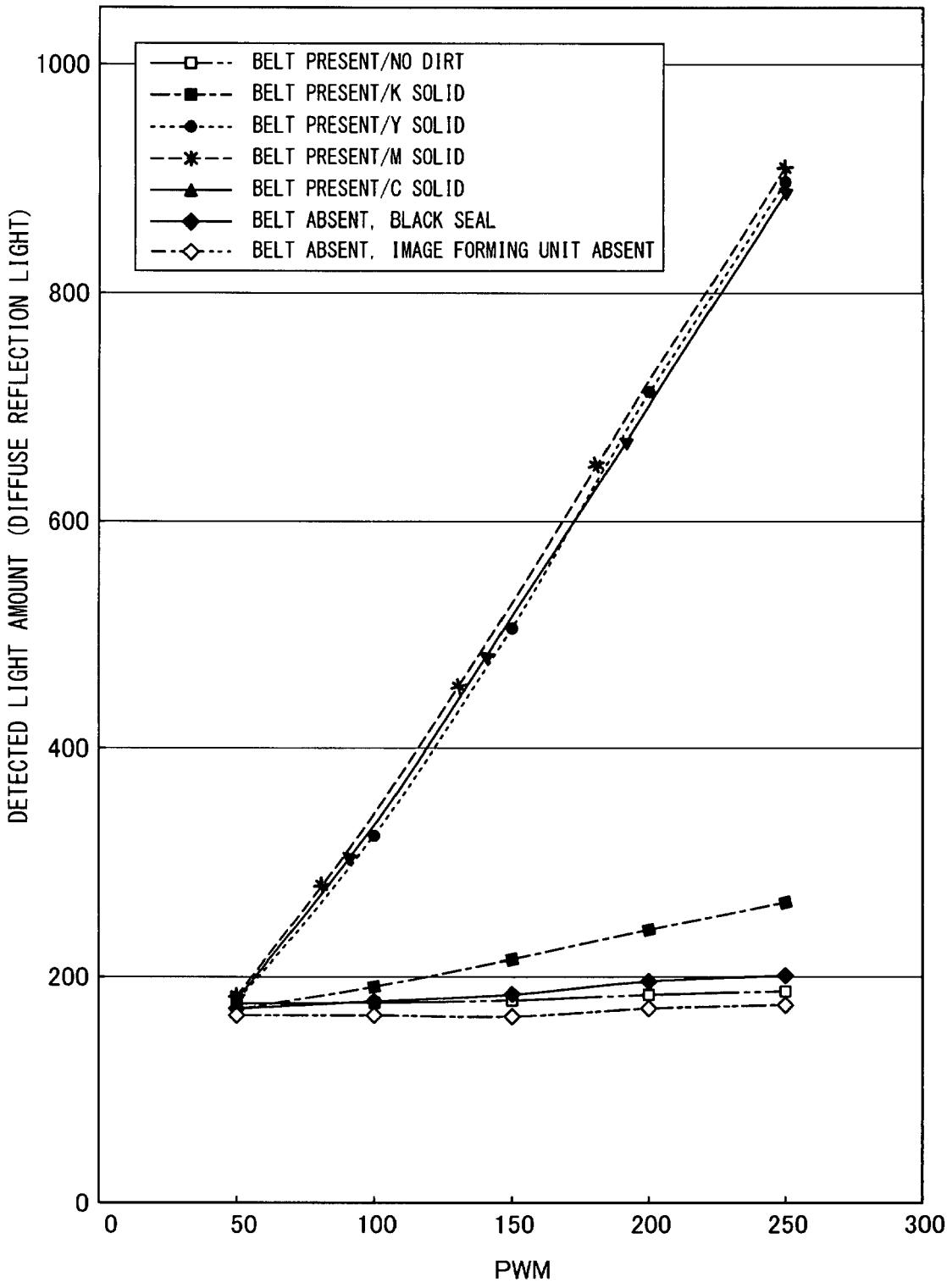
FIG. 8 is a graph that shows changes in detected light amounts of a diffuse reflection light-receiving element accompanying changes in outgoing light amounts of a light emitting element.

FIG. 7 is a graph that shows changes in light amounts detected by the specular reflection light-receiving element 92 accompanying changes in the amounts of outgoing light from the light emitting element 91. FIG. 8 is a graph that shows changes in light amounts detected by the diffuse reflection light-receiving element 93 accompanying changes in the amounts of outgoing light from the light emitting element 91. According to the present illustrative aspect, in the aforementioned PWM control by the CPU 80, as the PWM value rises, the outgoing light amount of the light emitting element 91 increases.

The respective graphs of FIGS. 7 and 8 show detected light amount changes in the following states.

"Belt present/no dirt": A state in which the belt unit 15 is disposed in the normal position (one example of the "predetermined position" position shown in FIG. 1) inside the casing 2, and toner or impurities are not adhering to the belt 18.

"Belt present/K solid": A state in which the belt unit 15 is disposed in the normal position and black toner is adhering to the belt 18.

"Belt present/Y solid": A state in which the belt unit 15 is disposed in the normal position and yellow toner is adhering to the belt 18.

"Belt present/M solid": A state in which the belt unit 15 is disposed in the normal position and magenta toner is adhering to the belt 18.

"Belt present/C solid": A state in which the belt unit 15 is disposed in the normal position and cyan toner is adhering to the belt 18.

"Belt absent, black seal": A state in which the image forming unit 110 is disposed inside the casing 2 but the belt unit 15 is not disposed therein, and outgoing light from the light emitting element 91 is radiated onto the aforementioned seal member 94.

"Belt absent, image forming unit absent": A state in which neither the image forming unit 110 nor the belt unit 15 is disposed inside the casing 2.

Looking at FIGS. 7 and 8 it is found that, in each state, the detected light amount of the specular reflection light-receiving element 92 changes accompanying changes in the outgoing light amount of the light emitting element 91. Accordingly, in a configuration that simply compares the detected light amounts of the light-receiving elements 92 and 93 with a certain threshold value, for example, when the detected light amounts of the light-receiving elements 92 and 93 decrease due to degradation over time of the light emitting element 91 or the light-receiving elements 92 and 93, there is a risk of a misdetermination being made in which, even though the belt unit 15 is disposed in the normal position, the detected light amounts of the light-receiving elements 92 and 93 fall below the aforementioned certain threshold value and, as a result, a determination is made that the belt unit 15 is not disposed in the normal position.

On the other hand, as shown in FIG. 7, it is found that, for example, when the PWM value is in a range of 50 to 200, the detected light amount of the specular reflection light-receiving element 92 changes linearly with respect to changes in the outgoing light amount of the light emitting element 91. Further, as shown in FIG. 8, it is found that, for example, when the PWM value is in a range of 50 to 250, the detected light amount of the diffuse reflection light-receiving element 93 changes linearly with respect to changes in the outgoing light amount of the light emitting element 91. More specifically, within each of the aforementioned ranges, for example, even if the outgoing light amount of the light emitting element 91 decreases, the amount of variation (slope) in the detected light amount of each of the light-receiving elements 92 and 93 is substantially constant with respect to the unit variation in the outgoing light amount of the light emitting element 91. The present illustrative aspect focuses on this fact and adopts a configuration which changes the outgoing light amount of the light emitting element 91, and determines whether or not the belt 18 (belt unit 15) is disposed in the normal position on the basis of a comparison between the amount of variation (slope) in the detected light amounts of each of the light-receiving elements 92 and 93 accompanying the change in the outgoing light amount and a first threshold value and a second threshold value (one example of "predetermined amount").

Further, as shown in FIGS. 7 and 8, in a state in which the belt 18 (belt unit 15) to which yellow, magenta, or cyan toner can be adhered is disposed in the normal position ("belt present/Y solid", "belt present/M solid", or "belt present/C solid"), the detected light amounts of the light-receiving elements 92 and 93 increase significantly accompanying an increase in the outgoing light amount of the light emitting element 91. In contrast, in a state in which the belt 18 (belt unit 15) to which black toner is adhered is disposed in the normal position ("belt present/K solid"), the detected light amounts of the light-receiving elements 92 and 93 increase with a gentle slope in comparison with when toner of another color is adhered to the belt 18. Accordingly, the aforementioned first threshold value and second threshold value are set to slightly smaller values (values larger than when in a "belt absent, black seal" state) than the amounts of variation (slopes) in the detected light amounts of each of the light-receiving elements 92 and 93 with respect to the unit amount of variation in the outgoing light amount of the light emitting element 91, in the "belt present/K solid" state.

Figure 9:
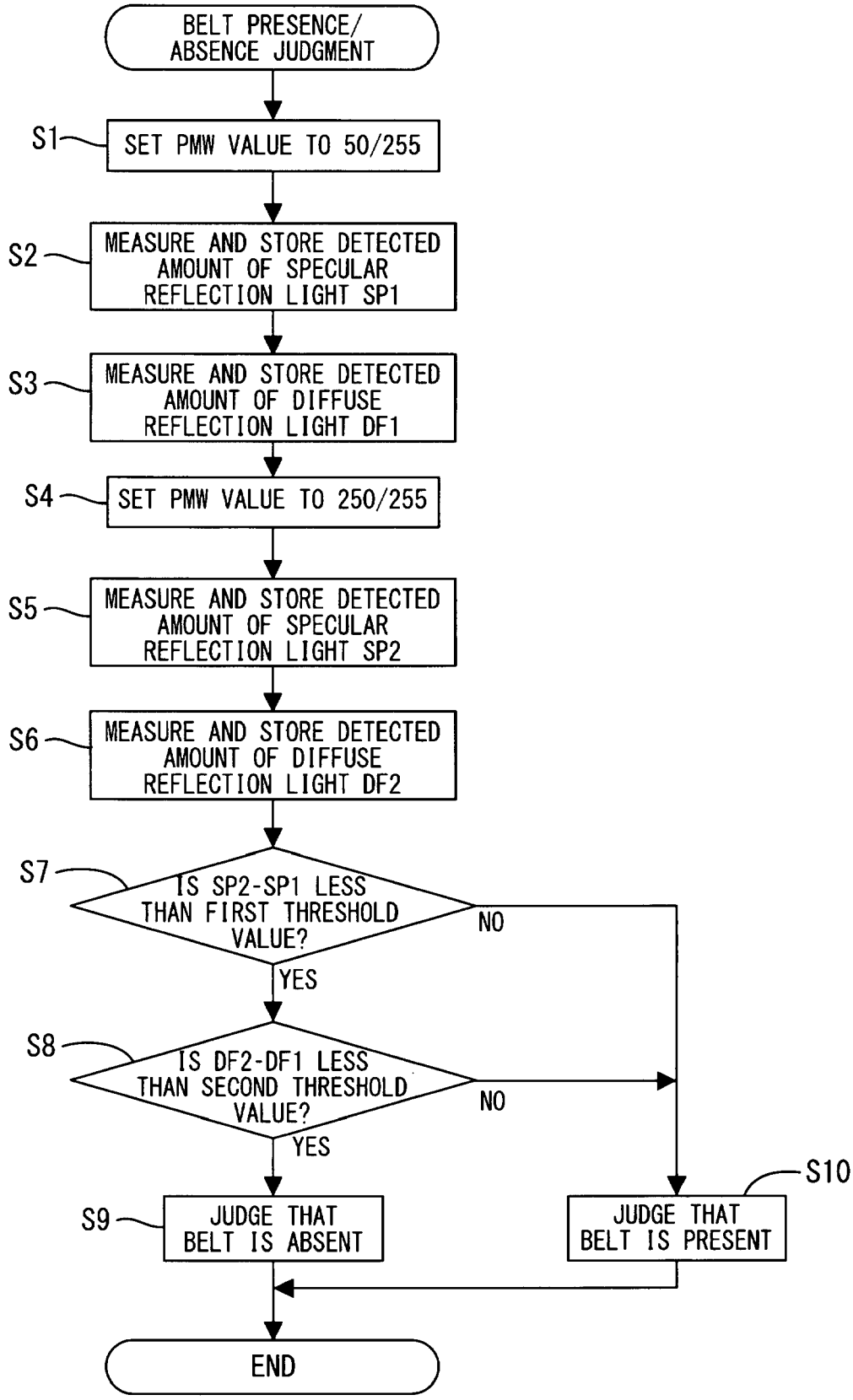
FIG. 9 is a flowchart that illustrates the procedure of processing to determine the presence or absence of a belt.

Hereunder, processing by the CPU 80 to determine the presence or absence of the belt unit 15 (belt 18) will be described with reference to the flowchart shown in FIG. 9. Prior to driving each motor using the motor driving portion 86, the CPU 80 executes the belt presence/absence determination processing shown in FIG. 9 based on, for example, the power of the laser printer 1 being turned on or an operation to open and close the front cover 3. First, in S1, the CPU 80 sends a signal to the light emitting element 91 to emit light at a first light emission level at which the PWM value is set to, for example, 50/255. Next, in S2, the CPU 80 measures a detected amount of specular reflection light SP1 based on a received light signal from the specular reflection light-receiving element 92, and stores the measured value, for example, in the RAM 82. Further, in S3, the CPU 80 measures the detected amount of diffuse reflection light DF1 based on a received light signal from the diffuse reflection light-receiving element 93, and stores the measured value, for example, in the RAM 82.

Subsequently, in S4, the CPU 80 sends a signal to the light emitting element 91 to emit light at a second light emission level at which the setting of the PWM value is changed to, for example, 250/255. Next, in S5, the CPU 80 measures a detected amount of specular reflection light SP2 based on a received light signal from the specular reflection light-receiving element 92, and stores the measured value, for example, in the RAM 82. Further, in S6, the CPU 80 measures a detected amount of diffuse reflection light DF2 based on a received light signal from the diffuse reflection light-receiving element 93, and stores the measured value, for example, in the RAM 82. At this time, the CPU 80 functions as a "light emission control portion".

Next, in S7, the CPU 80 determines whether a difference between the aforementioned detected amount of specular reflection light SP1 and the detected amount of specular reflection light SP2 is less than or equal to the aforementioned first threshold value. If the difference exceeds the first threshold value ("N" at S7), the CPU 80 determines at S10 that the belt unit 15 (belt 18) is present. Further, even assuming a case in which the difference between the detected amount of specular reflection light SP1 and the detected amount of specular reflection light SP2 is less than or equal to the first threshold value ("Y" at S7), when a difference between a detected amount of diffuse reflection light DF1 and a detected amount of diffuse reflection light DF2 exceeds the aforementioned second threshold value at S8 ("N" at S8), the CPU 80 determines at S10 that the belt unit 15 (belt 18) is present. When the CPU 80 determines that the belt unit 15 is present, the CPU 80 allows driving of the belt 18 and the like by control of the motor driving portion 86.

In contrast, when the difference between the detected amount of diffuse reflection light DF1 and the detected amount of diffuse reflection light DF2 is less than or equal to the aforementioned second threshold value ("Y" at S8), the CPU 80 determines at S9 that the belt unit 15 (belt 18) is absent. At this time, the CPU 80 does not allow driving of the belt 18 or the like by control of the motor driving portion 86 and keeps the belt 18 in the stopped state, and for example, causes the display portion 88 to display a message to the effect that the belt unit 15 is not disposed, to thereby call the user's attention to that fact. Accordingly, the CPU 80 also functions as "determining portion".

According to the present illustrative aspect, a configuration is adopted that changes the outgoing light amount of the light emitting element 91 and then determines whether or not the belt unit 15 is disposed in the normal position on the basis of a comparison between the amount of variation (slope) in the detected light amounts of the light-receiving elements 92 and 93 that accompanies that change in the outgoing light amount and a first threshold value and a second threshold value. Accordingly, even if the detected light amount at each of the light-receiving elements 92 and 93 fluctuates, it is possible to stably determine whether or not the belt unit 15 is disposed in the normal position.

Further, because the configuration is one that determines the presence or absence of the belt unit 15 utilizing the density sensor 90 that is used with image density control, the number of components can be reduced in comparison to a configuration that provides a special-purpose sensor, and thus costs can be reduced.

Furthermore, according to the present illustrative aspect, since determination regarding the presence or absence of the belt unit 15 is performed by also taking into account the detected light amount of the diffuse reflection light-receiving element 93, and not just the detected light amount of the specular reflection light-receiving element 92, the determination accuracy is enhanced.

Furthermore, a black seal member 94 can be attached to the bottom surface X of the rear end portion of the above described process cartridge 26 at which outgoing light from the light emitting element 91 is irradiated in a state in which the belt unit 15 is absent. Accordingly, in a state in which the belt unit 15 is absent, since it is possible to reduce the light that is incident on the light-receiving elements 92 and 93, a determination regarding the presence or absence of the belt unit 15 can be performed with greater accuracy.

Further, normally, the light reflectance ratio of black toner is low and a change in the detected light amounts of the light-receiving elements 92 and 93 when changing the outgoing light amount of the light emitting element 91 is also small. Accordingly, setting the first threshold value and the second threshold value by taking as a criteria the detection amount changes of the light-receiving elements 92 and 93 when the belt 18 is carrying a black toner image, a determination regarding the presence or absence of the belt 18 can be made more accurately.

According to the present illustrative aspect, since a determination as to whether or not an image carrier is disposed at a predetermined position is made on the basis of changes in detected light amounts of both specular reflection light and diffuse reflection light, a determination with higher precision can be expected.

When measuring the density, in order to improve the measuring precision it is desirable to adjust the outgoing light amount of the light emitting portion in accordance with the kind of density pattern. Therefore, in many cases the density sensor 90 is originally positioned with a function for changing the outgoing light amount of the light emitting portion. Accordingly, it is preferable to utilize the density sensor 90 when determining whether or not the image carrier is in a predetermined position.

<Other Illustrative Aspects>

The present invention is not limited to the illustrative aspect described by the foregoing description and drawings. For example, the following aspects are also included in the technical scope of the present invention.

(1) Although in the above described illustrative aspect the light emitting portion and the light receiving portion are configured as the light emitting element 91 and the light-receiving elements 92 and 93 of the density sensor 90, the present invention is not limited thereto. For example, a configuration may be adopted in which an apparatus has a function that causes an image carrier to bear a registration mark pattern for each color and adjusts (one example of "formation control") a transfer position of each color image based on the detection timing of the registration mark pattern of each color at a registration mark sensor that is disposed adjacent to the belt 18. In this case, the apparatus can determine the presence or absence of the image carrier utilizing the aforementioned registration mark sensor. Further, although the number of components will increase, a configuration may also be adopted in which a special-purpose light emitting portion and light receiving portion are separately positioned for determining the presence or absence of the image carrier.

(2) Although a so-called "reflection-type sensor" is utilized in the above described illustrative aspect, for example, in a case in which the belt 18 is formed with a optically transparent material, the present invention can also be implemented even if the light emitting portion and the light receiving portion are disposed in a condition that sandwiches the belt 18, and the sensor is a "transmission-type sensor."

(3) In the above described illustrative aspect a configuration is adopted in which the level of light emission of the light emitting element 91 is changed in two stages and a determination regarding the presence or absence of the belt unit 15 is made based on the amount of variation in the detected light amounts of the light-receiving elements 92 and 93 in correspondence with each light emission level. However, the present invention is not limited as such, and a configuration may also be adopted in which the level of light emission of the light emitting element 91 is changed in three or more stages and determination is made based on the patterns of change in the detected light amounts of the light-receiving elements 92 and 93 in correspondence with the respective light emission levels. In this connection, the configuration may be one in which the light emission level of the light emitting element 91 changes successively in a state in which light is emitted, or may be one in which light emission of the light emitting element 91 is stopped temporarily after light is emitted at a certain light emission level, and the light emitting element 91 is then caused to emit light at a changed light emission level at the next sampling timing for the detected light amount.

(4) Although the above described illustrative aspect adopted the black seal member 94 as a light absorbing member, the present invention is not limited thereto, and the light absorbing member may be a member of a color other than black as long as it is a member for which the amount of light reflected to the light receiving portion is less than that of light that would be reflected from the image carrier to the light receiving portion. Further, for example, a configuration may be adopted that utilizes a reflecting member that totally reflects the outgoing light from the light emitting portion substantially away from the light receiving portion.

(5) Even if the belt unit 15 is disposed inside the casing 2, in some cases the belt unit 15 may be disposed in a state in which it is misaligned with the normal position. In this case, the detected light amounts of the light-receiving elements 92 and 93 may vary. Accordingly, by strictly setting the first threshold value and the second threshold value it is possible to not only to determine whether or not the belt unit 15 is present inside the casing 2, but also whether or not the belt unit 15 is disposed in the normal position as shown in FIG. 1.

(6) Although the above illustrative aspect was described taking the example of a color laser printer 1, the present invention is not limited thereto, and the image forming apparatus may also be a black and white printer.

(7) According to the above described illustrative aspect a configuration is adopted in which a determination regarding the presence or absence of the belt unit 15 is performed by also taking into account the detected light amount of the diffuse reflection light-receiving element 93, and not just the detected light amount of the specular reflection light-receiving element 92. However, the present invention is not limited thereto, and a configuration may also be adopted that makes a determination based on only one of these two kinds of detected light amounts.

What is claimed is:

1. An image forming apparatus, comprising:

an image carrier that includes a developer image;

a light emitting portion for emitting a light towards a predetermined position;

a light receiving portion for detecting a light amount of incident light from the predetermined position;

a light emission control portion for changing an outgoing light amount of the light emitting portion; and a determining portion for determining whether or not the image carrier is disposed in the predetermined position on the basis of a change in detected light amounts of the light receiving portion accompanying a change in the outgoing light amount of the light emitting portion.

2. The image forming apparatus according to claim 1, wherein the determining portion determines that the image carrier is not disposed in the predetermined position when a change in a detected light amount at the light receiving portion is less than a predetermined amount, and determines that the image carrier is disposed in the predetermined position when a change in a detected light amount at the light receiving portion is greater than a predetermined amount.

3. The image forming apparatus according to claim 1, further comprising a developer image formation control portion for performing developer image formation control based on a detected light amount of the light receiving portion.

4. The image forming apparatus according to claim 3, wherein the light emitting portion and the light receiving portion are configured as a density sensor that measures a density of a developer image on the image carrier, and the developer image formation control portion controls a density of a developer image to be formed on the image carrier, based on a measurement result of the density sensor.

5. The image forming apparatus according to claim 1, wherein:

the light receiving portion includes a first light-receiving element for detecting a specular reflection light of an outgoing light from the light emitting portion and a second light-receiving element for detecting a diffuse reflection light of an outgoing light from the light emitting portion, and the determining portion determines whether or not the image carrier is disposed in the predetermined position on the basis of a change in a detected light amount of at least one of the first light-receiving element and the second light-receiving element.

6. The image forming apparatus according to claim 5, wherein the determining portion determines whether or not the image carrier is disposed in the predetermined position on the basis of a change in a detected light amount of both the first light-receiving element and the second light-receiving element.

7. The image forming apparatus according to claim 1, further comprising a light absorbing member disposed at a position where the light emitted from the light emitting portion irradiates when an image carrier is not disposed, wherein the light absorbing member is configured so that incident light to the light receiving portion is less than incident light to the light receiving portion if the image carrier is disposed.

8. The image forming apparatus according to claim 1, further comprising a light absorbing member disposed at a position where the light emitted from the light emitting portion irradiates when the image carrier is not disposed, wherein the light absorbing member includes a material for which an amount of incident light on the light receiving portion is less than the incident light to the light receiving portion if the image carrier is disposed.

9. The image forming apparatus according to claim 1, wherein:

the image carrier includes a black developer image, a threshold value for determining whether or not the image carrier is disposed in the predetermined position at the determining portion is set to a value that is between a variation amount of a detected light amount of the light receiving portion in a state in which the image carrier is disposed at the predetermined position and includes the black developer image and a variation amount of a detected light amount of the light receiving portion in a state in which the image carrier is not disposed at the predetermined position.

10. An image forming apparatus, comprising:

an image carrier;

a light emitting portion for emitting a light towards a predetermined position;

a light receiving portion for detecting a light amount of incident light from the predetermined position;

a light emission control portion for changing an outgoing light amount of the light emitting portion; and a determining portion for determining whether or not the image carrier is disposed in the predetermined position based on a change in detected light amounts at the light receiving portion including a change in the outgoing light amount of the light emitting portion.

11. The image forming apparatus according to claim 10, wherein the determining portion determines that the image carrier is not disposed in the predetermined position when a change in a detected light amount at the light receiving portion is less than a predetermined amount.

12. The image forming apparatus according to claim 10, wherein the determining portion determines that the image carrier is disposed in the predetermined position when a change in a detected light amount at the light receiving portion is greater than a predetermined amount.

13. The image forming apparatus according to claim 10, further comprising a developer image formation control portion for performing developer image formation control based on a detected light amount of the light receiving portion.

14. The image forming apparatus according to claim 13, wherein the light emitting portion and the light receiving portion are configured as a density sensor that measures a density of a developer image on the image carrier.

15. The image forming apparatus according to claim 14, wherein the developer image formation control portion controls a density of a developer image to be formed on the image carrier, based on a measurement result of the density sensor.

16. The image forming apparatus according to claim 10, wherein the light receiving portion includes a first light-receiving element for detecting a specular reflection light of an outgoing light from the light emitting portion.

17. The image forming apparatus according to claim 16, further including a second light-receiving element for detecting a diffuse reflection light of an outgoing light from the light emitting portion.

18. The image forming apparatus according to claim 17, wherein the determining portion determines whether or not the image carrier is disposed in the predetermined position on the basis of a change in a detected light amount of at least one of the first light-receiving element and the second light-receiving element.

19. The image forming apparatus according to claim 18, wherein the determining portion determines whether or not the image carrier is disposed in the predetermined position on the basis of a change in a detected light amount of both the first light-receiving element and the second light-receiving element.

20. The image forming apparatus according to claim 10, further including a light absorbing member, wherein the light absorbing member is configured to reflect less light than the image carrier.

* * * * *